United States Patent [19]

Brooks

[11] Patent Number: 4,749,478

[45] Date of Patent: Jun. 7, 1988

[54] CLEANING UNIT FOR COLLECTING DEBRIS IN A SWIMMING POOL

[75] Inventor: David A. Brooks, Roodepoort, South Africa

[73] Assignee: Spooner EST, Vaduz, Liechtenstein

[21] Appl. No.: 927,870

[22] Filed: Nov. 7, 1986

[51] Int. Cl.[4] ..... E04H 3/16

[52] U.S. Cl. ..... 210/169; 210/416.2; 134/167 R; 15/1.7

[58] Field of Search ..... 210/169, 416.2, 242.1, 210/238; 15/1.7, 354; 134/167 R; 4/490

[56] References Cited

U.S. PATENT DOCUMENTS

| | | | |
|---|---|---|---|
| 2,902,705 | 9/1956 | Eistrup | 15/1.7 |
| 3,032,044 | 5/1962 | Pansini | 134/167 R |
| 3,063,077 | 11/1962 | Pansini | 15/1.7 |
| 3,108,298 | 10/1963 | Gelinas | 210/169 |
| 3,261,371 | 7/1966 | Vernon | 210/169 |
| 3,291,145 | 12/1966 | Arneson | 134/167 R |
| 3,295,540 | 1/1967 | Ortega | 15/1.7 |
| 3,758,276 | 4/1973 | Bond et al. | 210/169 |
| 3,860,518 | 1/1975 | Henricksen | 210/169 |
| 3,926,667 | 12/1975 | Gibellina | 134/167 R |
| 3,972,339 | 8/1976 | Henkin et al. | 15/1.7 |
| 4,040,864 | 8/1977 | Steeves | 134/167 R |
| 4,087,286 | 5/1978 | Sexton | 134/167 R |
| 4,169,484 | 10/1979 | Bonigut et al. | 134/167 R |
| 4,178,949 | 12/1979 | Mazon, III | 134/167 R |
| 4,281,995 | 8/1981 | Pansini | 134/167 R |
| 4,289,155 | 9/1981 | Sable | 134/167 R |
| 4,348,192 | 9/1982 | Pansini | 134/167 R |
| 4,356,582 | 11/1982 | Stephenson | 134/167 R |
| 4,429,429 | 2/1984 | Altschul | 134/167 R |
| 4,431,538 | 2/1984 | Selsted | 210/169 |
| 4,503,874 | 3/1985 | Norton | 134/167 R |
| 4,584,733 | 4/1986 | Tietge et al. | 15/1.7 |

FOREIGN PATENT DOCUMENTS

| | | | |
|---|---|---|---|
| 2255784 | 5/1973 | Fed. Rep. of Germany | 210/169 |
| 2209137 | 8/1973 | Fed. Rep. of Germany | 134/167 R |
| 2360029 | 6/1975 | Fed. Rep. of Germany | 210/169 |

*Primary Examiner*—Peter Hruskoci
*Assistant Examiner*—Coreen Y. Lee

[57] ABSTRACT

A cleaning unit for collecting debris in a swimming pool has a hollow main body that is pivotally connected to a leading end section. The leading end section and the main body may pivot through about 10° when in an operative configuration to accommodate curvature of a wall or floor of the swimming pool. The leading end section and the main body are kept in the operative configuration by fingers. The fingers extend from the leading end section into the main body and may be disengaged so that the leading end section may be folded over. The main body defines a mouth at its front end and houses a bag in which debris is collected. When the leading end section is folded over the bag may be removed for cleaning and re-inserted. The leading end section has a tubular conduit which is connectable at its leading end to a supply hose. The tubular conduit carries a displacing jet for displacing the unit. Two wing-like triangular extensions are secured to the conduit so that the leading end section has a substantially triangular profile. The leading end section and the main body carry wheels at their peripheries.

30 Claims, 4 Drawing Sheets

CLEANING UNIT FOR COLLECTING DEBRIS IN A SWIMMING POOL

FIELD OF THE INVENTION

This invention relates to automatic swimming pool cleaning apparatus, more particularly a cleaning unit for collecting debris in the swimming pool.

DESCRIPTION OF THE PRIOR ART

There are a large number of patents for apparatus for automatically cleaning swimming pools. In particular, U.S. Pat. No. 4,040,864—Steeves discloses a device for cleaning leaves and debris from swimming pools which has a reticulated bag having an open mouth and closed end. The mouth is connected to the nozzle of a high pressure water hose and the hose is dragged around the pool by a floating body. The bag may be buoyed so that it moves about the surface or it may be non-buoyant, so that it sinks to the bottom of the pool and moves along the floor thereof.

A further device for cleaning the sidewalls of a swimming pool at the water line, is disclosed in U.S. Pat. No. 4,040,864—Altschul. This patent discloses a buoyant unit which is connected to a hose that supplies water under pressure and the device is displaced by a water jet and drags the hose along behind it. The Altschul device has a bag in which leaves and other debris are collected.

BRIEF DESCRIPTION OF THE INVENTION

It is an object of the invention to provide an improved cleaning unit for collecting debris in a swimming pool. It is an object not only to collect debris that is lying on the floor of the swimming pool or that is in the vicinity of the sidewalls at the waterline thereof, but also to collect leaves and other debris that is in suspension in the body of water.

Accordingly, the invention provides a cleaning unit for collecting debris in a swimming pool which has two basic parts, a hollow main body that forms a housing for a bag in which the debris is collected and a leading end section that is hingedly connected to the main body. The leading end section has a centrally positioned tubular member that is connectable at its leading end to a supply hose which supplies water under pressure and at its trailing end, adjacent the main body and on its upper side, it has a displacing jet through which water exits in a generally downstream direction to push the leading end section in a forward direction. The leading end section has two wing-like extensions which extend from the tubular member. The leading end section is generally triangular in shape with a broad trailing end and a vertex at its leading end. The leading end section is thus streamlined and the wing-like extensions are angled to produce a downward thrust when the unit moves forward through the water. Further, the tubular member carries an auxiliary jet on its underneath side which is also directed rearwardly to provide a jet of water to entrain debris and cause it to flow into the bag.

The main body has a relatively wide and substantially flat bottom wall and a relatively wide and substantially flat top wall which overlies and is generally parallel to the bottom wall, with relatively narrow sidewalls connecting the top and bottom walls. The front side of the main body, adjacent the leading end section, is open and defines a mouth. A debris collecting bag is located in the main body with its opening coincident with the mouth and held in place by a relatively rigid but nonetheless flexible collar. The top and bottom walls and sidewalls of the main body have openings through which water may pass.

The leading end section is hingedly connected to the main body so that it can pivot, in an operative configuration, between a lowered position in which the wing-like extensions are substantially level with the top wall and a raised position in which the wing-like extension are inclined upwardly from the top wall of the main body, at a slight angle. Thus, the main body and the leading end section may pivot to follow curved wall and floor sections of the pool. The leading end section is held in its operative configuration by two detent fingers which extend into the main body. These fingers are flexible so that the leading end section may be pivoted downwardly with respect to the main body, sufficiently to disengage the fingers so that they are deformed and withdrawn from the housing. The leading end section may the be pivoted through approximately 180° so that its lower side abuts the lower side of the bottom wall of the main body to provide access to the bag.

The unit has a number of wheels to minimise scraping against the wall and floor of the swimming pool. Thus, at the tip of each wing-like extension there is a wheel rotatable about an axis that is transverse to the wing-like extensions, and a wheel that is rotatable about an axis that is parallel to the wing-like extension and transverse to the tubular member. Similarly, the rear end of the main body has two planar triangular fins which have similar wheels at their apexes.

It will be appreciated that a cleaning unit in accordance with the invention is streamlined to enable it to move easily through the water, has stabilising surfaces so that it moves in a relatively stable manner through the water, can flex to accommodate curved wall and floor portions, provides a protective housing for a debris collecting bag and has a suitable structure to provide easy access to the bag so that the bag may be removed for cleaning.

BRIEF DESCRIPTION OF THE DRAWINGS

The invention is now described, by way of an example, with reference to the accompanying drawings, in which.

DESCRIPTION OF THE PREFERRED EMBODIMENT

Figure 1:
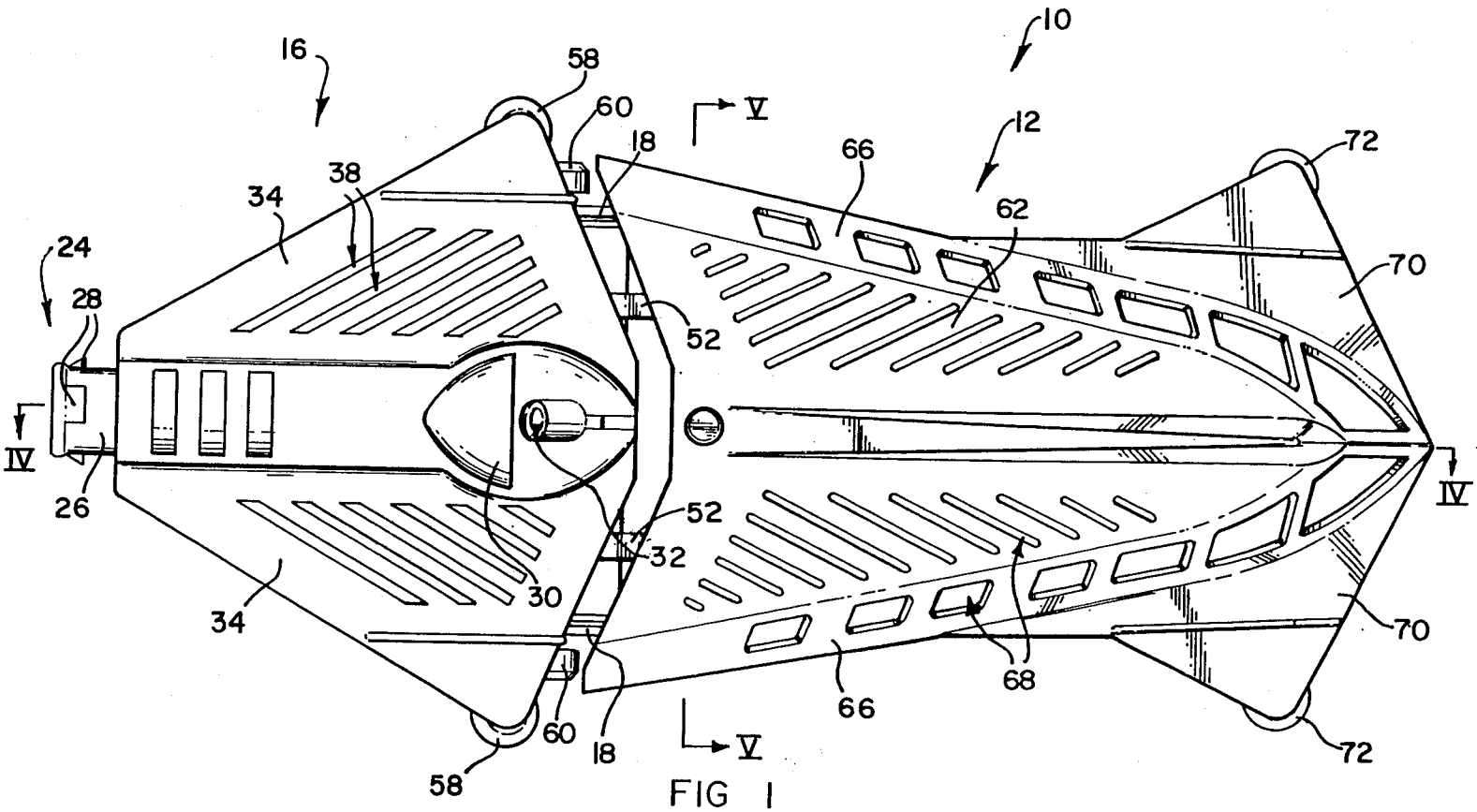
FIG. 1 shows a plan view of a cleaning unit in accordance with the invention.
Figure 2:
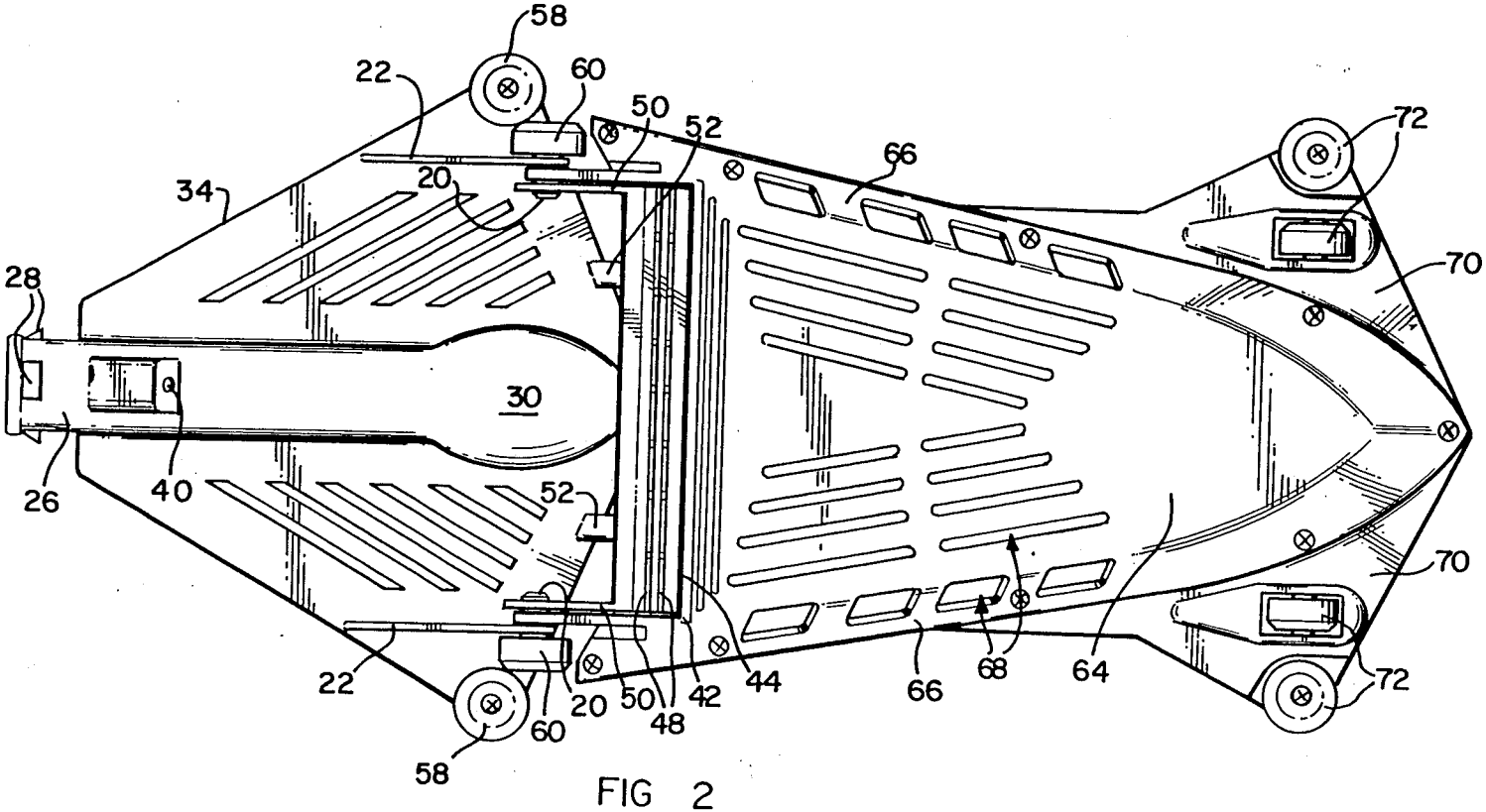
FIG. 2 shows an underneath view of the unit.

Referring to the drawings, a cleaning unit for collecting debris in a swimming pool is indicated generally by reference numeral 10. The cleaning unit 10 has two main parts—a main body 12 that is hollow and constitutes a housing for a bag 14 and a leading end section 16. The main body 12 has two arms 18 which are pivotally secured at their leading, free ends by means of pivot pins 20 to mounting brackets 22 on the leading end section 16.

The leading end section 16 is substantially triangular in plan view having its apex at its leading end 24. More particularly, the leading end section 16 comprises a tubular conduit member 26 which has securing formations 28 at its free end by means of which the unit is coupled to a supply hose (not shown) which supplies water under pressure to the unit. At its trailing end, the member 26 has a bulbous formation 30 in which is mounted a displacing jet 32 on its upper side, and rearwardly directed at an angle such that water flowing out of the jet produces a thrust having a downward component and a forwardly directed component. Two wing-like extensions 34 are secured to the member 26 and are substantially planar, defining a median plane between the upper and lower sides of the tubular member 26. However, the wing-like extensions 34 are at a slight angle, sloping upwardly from front to back to provide a downward thrust as the leading end section 16 moves forwardly through the water. The wing-like extensions 34 have openings 38. Further, the tubular member 26 carries an auxiliary jet 40 on its underneath side and which is rearwardly directed at an angle. Water flowing out of this jet 40 entrains dirt and transports such dirt into the bag 14 as will be explained below.

Further, a flow directing member and scraper 42 is also pivotally attached to the leading end section 16 by means of the pivot pins 20. This scraper 42 has a blade 44 that has an upwardly sloped upper surface 46 and an underneath surface that has ribs 48. The blade 44 is attached at its ends to two securing arms 50 by means of which it is attached to the pivot pins 20.

In regard to the leading end section 16 it has two fingers 52 with hook-like formations 54 at their ends which engage complementary shaped retaining formations 56 carried by the body 12. At the lateral extremities, the wing-like extensions 34 carry wheels 58 that are rotatable about axes that are parallel to one another and perpendicular to the plane of the wing-like extensions 34. Further wheels 60 are carried by the pivot pins 20 to be rotatable about axes that are parallel to the wing-like extensions 34 and transverse to the tubular member 26.

Figure 3:
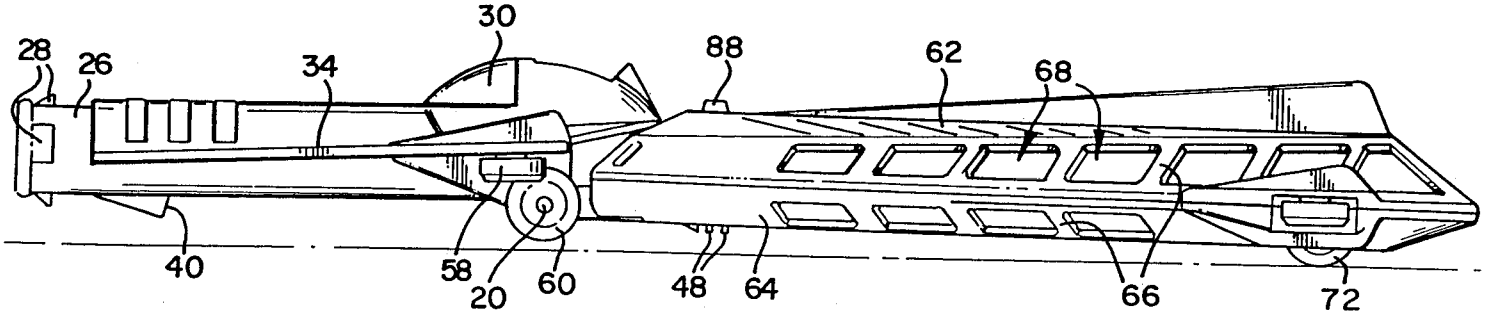
FIG. 3 shows a side view of the unit.
Figure 4:
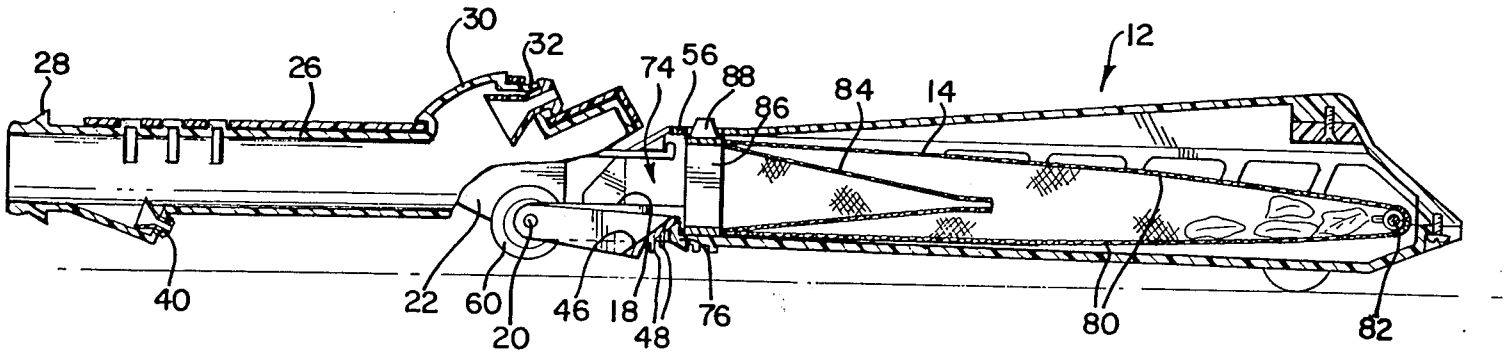
FIG. 4 shows a longitudinally sectioned view of the unit along line IV—IV in FIG. 1.
Figure 5:
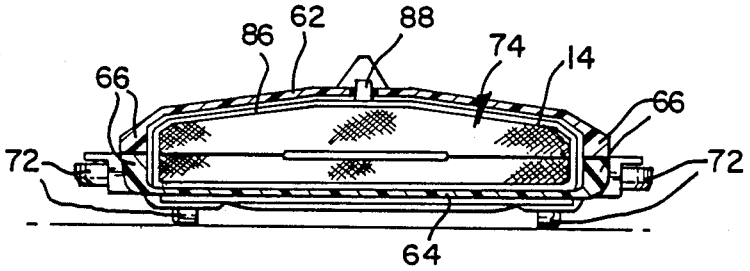
FIG. 5 shows a transversely sectioned view along line V—V in FIG. 1.
Figure 6:
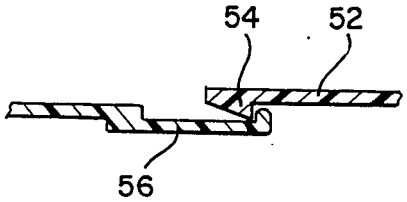
FIG. 6 shows a detailed view indicating the operation of detent fingers of the unit.

Referring now to the main body 12, it is defined by a substantially flat top wall 62 that is triangular having a relatively wide front end, a similar bottom wall 64 and sloped sidewalls 66. The top and bottom walls 62 and 64 and the sidewall 66 have apertures 68 constituted by large open areas in the sidewall and slots in the top and bottom walls. At the rear end of the main body 12 there are two fins 70 which are substantially planar and are substantially parallel to the wing-like extensions 34. The fins 70 carry wheels 72 that are rotatable similarly to the wheels 58 and 60. As is seen in FIG. 3, the wing-like extensions 34 are substantially aligned with the top wall 62 when the cleaning unit 10 is in a lowered operative configuration such as is shown in FIGS. 3 and 4. In its operative configuration as shown in FIGS. 3 and 4 the leading end section 16 and the main body 12 are slightly relatively pivotal, about the pivot pins 20, such that the leading end section 16 may be raised about 10° to 15° relative to the main body 12. It will be appreciated that the leading ends of the top and bottom walls 62 and 64 and the sidewalls 66 define a mouth 74 and as the leading end sections 16 pivots relative to the main body 10, in their operative configuration, the bottom leading end of the bottom wall 64 is able to stay close to curved sections of a wall and floor of the swimming pool. As shown in FIG. 4, the trailing edge of the blade 46 lies adjacent this leading end 76 so that water with debris entrained, in particular water supplied via the auxiliary jet 40 is deflected into the mouth 74.

The bag 14 is made of two sheets 80 of a woven material with a length of wire 82 which is used to stiffen the perimeter of the bag. Within the bag 82 there is a check valve 84 formed from two further flaps of material. The sheets 80 and the flaps 84 are secured to a collar 86 that is of a relatively rigid but nonetheless flexible material. The collar 86 has a knob 88 which is received in an aperture close to the leading edge of the top wall 62 which locates the collar 86 in the mouth 74 and a groove in the opposite inner front end of the bottom wall 64.

Figure 7:
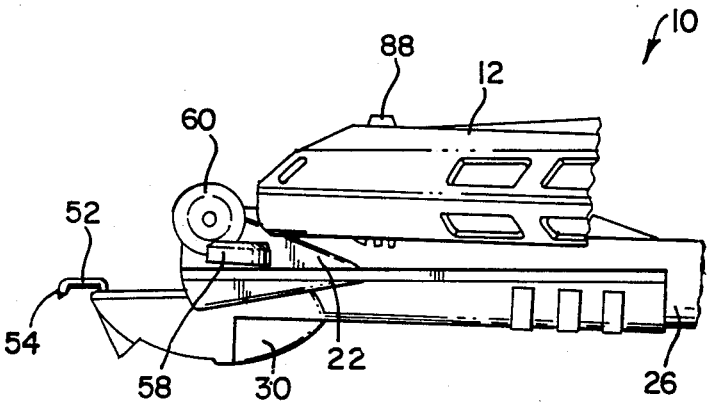
FIG. 7 shows a side view of part of the unit in its folded over configuration to permit access to the bag.

Finally, referring to FIG. 7, it will be noted that the fingers 52 may be disengaged from the main body 12 so that the leading end section 16 may be folded over through 180° to lie against the bottom wall 64 thereby providing access to the bag 14. In this folded over configuration, the knob 88 may be depressed to disengage it from its complementary aperture and the bag may then be removed. The bag 14 may be similarly reinserted into the main body 12. To return the unit to its operative configuration the folded over section is pivoted back and the fingers 52 manually deformed to once again enter the mouth 74.

I claim:

1. A cleaning unit for collecting debris in a swimming pool, comprising a main body having a substantially flat bottom wall, a top wall overlying and substantially parallel to the bottom wall, and sidewalls connecting the top and bottom walls;

a front side of the main body being open and defining a mouth opening into the interior of the main body, and the top and bottom walls and the sidewalls of the main body having a plurality of openings for the flow of water out of the interior;

a substantially flat leading end section extending forwardly from the top wall to overlie and extend forwardly from the mouth, the leading end section being pivotally connected to the main body to pivot between a lowered position substantially level with the top wall and a raised position inclined upwardly from the mouth;

a debris collecting means in the main body for collecting debris from water passing into the mouth and through the main body;

a water conduit on the leading end section extending from a forward end of the leading end section rearwardly toward the main body;

a coupling means on the leading end section for coupling a front end of the water conduit to a movable source of water under pressure;

a jet means on the conduit for directing water under pressure away from the leading end section to produce thrust having a component that is directed parallel to the leading end section and rearwardly for displacing the leading end section and the connected main body in the water to collect debris;

and a plurality of wheels carried by the main body, at least some of the wheels being rotatable about axes that are substantially transverse to the bottom wall.

2. A cleaning unit as defined in claim 1 further including a second jet means on a bottom side of the conduit positioned to direct a flow of water under pressure from the leading end section rearwardly toward the mouth.

3. A cleaning unit as defined in claim 2 in which the first-mentioned jet means is on a top side of the leading end section adjacent a leading end of the main body, and is positioned when the leading end section is in the lowered position to produce thrust having a component directed downwardly to urge the leading end section down and a component directed downwardly for propelling the leading end section forwardly.

4. A cleaning unit as defined in claim 3 in which the second jet means is positioned, when the leading end section is in the lowered position, to direct its flow of water rearwardly and downwardly toward an area immediately ahead of the mouth.

5. A cleaning unit as defined in claim 1 wherein the debris collecting means comprises a bag composed of open net fabric having an open end disposed in and substantially the same in size and shape as the mouth, the bag extending rearwardly from the mouth within the main body, and further including means for releasably securing the bag to the main body around said mouth.

6. A cleaning unit as defined in claim 5 wherein the means for releasably securing the bag include a frame fitted inside the mouth and secured to the open end of the bag, and opposed detent means on the frame and the main body, the frame being resiliently flexible for disengagement of the detent means.

7. A cleaning unit as defined in claim 5 wherein the bag has means adjacent the open end for permitting entry of water and debris and restricting a reverse flow of debris.

8. A cleaning unit as defined in claim 1 wherein the openings in the sidewalls form relatively large open areas.

9. A cleaning unit as defined in claim 1 wherein the openings in the top and bottom walls are formed by slots.

10. A cleaning unit as defined in claim 1 wherein the leading end section is formed with substantial open areas for passage of water therethrough.

11. A cleaning unit as defined in claim 1 wherein the conduit comprises an elongated tubular body that is centrally located on the leading end section, the latter constituting two wing-like lateral projections having laterally outer edges substantially even with the laterally outer sides of the main body at the mouth.

12. A cleaning unit as defined in claim 11 wherein the wing-like projections are substantially planar and are slightly angled with respect to the tubular body, to slope upwardly from front to back.

13. A cleaning unit as defined in claim 11 wherein the leading end section is generally triangular in shape with a broad trailing end and a vortex at its leading end.

14. A cleaning unit as defined in claim 1 in which the leading end section has lateral extremes substantially aligned with the lateral extremes of the sidewalls, and the wheels are on the lateral extremes of the leading end section for rolling engagement with a pool wall beside the leading end section.

15. A cleaning unit as defined in claim 1 in which the leading end section is generally triangular in shape with one of the wheels on the corner at each end of the base of the triangular shape, and the sidewalls have laterally projecting fins with one of the wheels at the lateral extremity of each fin.

16. A cleaning unit as defined in claim 1 further including a wheel on the underside of the leading end section for reducing resistance to lateral movement of the leading end section along walls defining the swimming pool.

17. A cleaning unit as defined in claim 16 comprising at least one wheel that is mounted on the leading end section to rotate about a transverse axis and having a lower side spaced below the underside of the leading end section.

18. A cleaning unit as defined in claim 1 further including a scoop movably mounted on the leading end section to lie in front of the mouth and to hang below the mouth when the latter is spaced above a floor of the pool over which the main body is moving, the scoop having a lower scraping edge and being inclined upwardly and rearwardly from the lower edge to deflect water and debris upwardly toward the mouth as the leading end section and the main body move through the water.

19. A cleaning unit as defined in claim 18 wherein the scoop is a generally U-shaped part having generally parallel legs at opposite ends of the lower scraping edge, the legs being pivotally connected to the leading end section on opposite sides of the mouth.

20. A cleaning unit as defined in claim 1 wherein the leading end section and the main body have interacting detent means nominally limiting relative pivoting of the leading end section between its lowered position and its raised position, the interacting detent means being selectively disengageable to permit pivoting of the leading end section relative to the main body in the opposite direction for access to the interior of the main body.

21. A cleaning unit as defined in claim 20 wherein the interacting detent means comprises at least one finger projecting rearwardly into the mouth from the leading end section, and a spaced, opposed surface on the mouth for blocking engagement with the finger.

22. A cleaning unit as defined in claim 21 wherein the finger is resiliently flexible, and is bendable for selective disengagement.

23. A cleaning unit as defined in claim 20 wherein the interacting detent means are disengageable when the leading end section is displaced from its raised position to its lowered position, and the leading end section is pivotally connected to said main body to permit relative movement bringing together the bottom sides of the leading end section and the main body.

24. A cleaning unit for collecting debris in a swimming pool, comprising a non-buoyant body having a leading end for connection to a movable source of water under pressure, a substantially flat underside for movement through the pool and along a floor and wall of the swimming pool as the body is displaced through the water, and a topside and sidewalls, a scoop-like mouth formed at a forward end of the underside, adjacent the leading end, to face forwardly as the body is pulled through the water, the mouth having a lower edge for moving along the floor and wall of the swimming pool, the underside defining a hollow interior for receiving water and debris through the mouth, and a plurality of openings in the underside, topside, and sidewalls of the body rearwardly spaced from the mouth for the flow of water out of the body;

a delivery means for delivering water under pressure to the body adjacent the leading end thereof;

a jet means on the body for discharging water under pressure from the body to urge the body in the direction of the lower edge and thereby to urge the lower edge toward the pool floor and wall;

a collecting means in the body for collecting and holding debris as the body is displaced through the swimming pool;

and a plurality of wheels carried by the body, at least some of the wheels being rotatable about axes that are substantially transverse to the underside.

25. A cleaning unit for collecting debris as defined in claim 24 wherein the body is formed in two sections, a main section constituting a trailing end portion of the body and having an open front side constituting the mouth, and a leading end section extending forwardly from the main section above and beyond the mouth, the leading end section having coupling means thereon for connecting to the delivery means for delivering water.

26. A cleaning unit for collecting debris as defined in claim 25 wherein the leading end section is pivotally connected to the main section to swing between a lowered position extending forwardly substantially level with the main section and a raised position inclined upwardly from the mouth.

27. A cleaning unit for collecting debris as defined in claim 25 wherein the jet means includes a main jet mounted on the leading end section generally above the mouth and directed rearwardly and upwardly.

28. A cleaning unit for collecting debris as defined in claim 27 wherein the jet means includes an auxiliary jet mounted on the leading end section ahead of the mouth and directed rearwardly and downwardly.

29. A cleaning unit for collecting debris as defined in claim 24 wherein the collecting means comprises a bag composed of open-weave fabric having an open end of substantially the same size and shape as the mouth, and means releasably securing the bag in the body with the open end in the mouth to collect debris in the bag.

30. A cleaning unit for collecting debris as defined in claim 24 wherein the underside and topside have generally flat top and bottom walls that are spaced apart to form the mouth, the top wall extending beyond the mouth and tapering to form a generally triangular leading end section.

* * * * *